US008074812B1

(12) United States Patent
Bradbury

(10) Patent No.: US 8,074,812 B1
(45) Date of Patent: Dec. 13, 2011

(54) ROTARY TRACK MECHANISM FOR CORNER CABINETS

(75) Inventor: Michael Sean Bradbury, Eagle, CO (US)

(73) Assignee: Michael Sean Bradbury, Eagle, CO (US)

( * ) Notice: Subject to any disclaimer, the term of this patent is extended or adjusted under 35 U.S.C. 154(b) by 0 days.

(21) Appl. No.: 12/655,727

(22) Filed: Jan. 6, 2010

Related U.S. Application Data

(60) Provisional application No. 61/216,431, filed on May 18, 2009.

(51) Int. Cl.
*A47F 7/00* (2006.01)

(52) U.S. Cl. ..... 211/13.1; 211/70; 211/106.01; 211/144; 211/162; 211/184; 312/238; 312/305

(58) Field of Classification Search ..... 211/13.1, 211/70, 70.7, 78, 85.29, 106.01, 126.2, 131.1, 211/133.4, 144, 162, 184, 115; 248/307, 248/299.1; 312/238, 305, 271, 272
See application file for complete search history.

(56) References Cited

U.S. PATENT DOCUMENTS

| | | | | | |
|---|---|---|---|---|---|
| 877,751 | A | * | 1/1908 | Acheson | 312/222 |
| 1,132,190 | A | * | 3/1915 | Kohout | 211/85.3 |
| 1,255,584 | A | * | 2/1918 | Clark | 312/305 |
| 2,611,492 | A | * | 9/1952 | Watts | 211/113 |
| 2,758,904 | A | | 5/1954 | Hansell | |
| 3,175,243 | A | * | 3/1965 | Weber | 16/87.4 R |
| 3,198,594 | A | | 8/1965 | Murray | |
| 3,379,484 | A | | 4/1968 | Kling | |
| 3,780,875 | A | * | 12/1973 | Scholl | 211/115 |
| 3,982,800 | A | * | 9/1976 | Gorton et al. | 312/305 |
| 4,290,531 | A | * | 9/1981 | Lazarus, III | 211/85.29 |
| 4,714,166 | A | | 12/1987 | Hann | |
| 5,238,127 | A | | 8/1993 | Geller | |
| 5,249,856 | A | | 10/1993 | Dreier | |
| 6,017,108 | A | * | 1/2000 | Domenig | 312/305 |
| 6,039,191 | A | | 3/2000 | Purnell | |
| 6,227,387 | B1 | * | 5/2001 | Rose | 211/85.29 |
| 6,729,479 | B2 | | 5/2004 | Morgan | |
| 6,976,595 | B1 | | 12/2005 | Geller | |

* cited by examiner

*Primary Examiner* — Korie Chan

(57) ABSTRACT

A rotary hanging track storage unit for mounting in a corner cabinet includes a circular hanging track 4 and hanger assemblies 10, hanging guard assemblies 11, and hanger extensions 22. The track 7 is attached to and supported by hanging track brackets 3, hanging track clamps 5, track supports 6, and center shaft 7. The assembly can be rotated within the corner cabinet 2 where cookware and utensils can be hung from assemblies 10 and extensions 22 to be accessed and stored.

4 Claims, 6 Drawing Sheets

ROTARY TRACK MECHANISM FOR CORNER CABINETS

CROSS-REFERENCE TO RELATED APPLICATIONS

This application claims the benefit of PPA Ser. No. 61/216,431 filed 2009 May 18

FEDERALLY SPONSORED RESEARCH

None

SEQUENCE LISTING

None

BACKGROUND OF INVENTION FIELD OF INVENTION

This invention relates to cookware and utensil storage hangers, more specifically storage hangers that utilize the space inside of kitchen corner cabinets.

BACKGROUND

Kitchen corner cabinet cookware and utensil storage has always been awkward, inefficient, and cumbersome. The problem of storing several different sized and shaped cookware and utensils inside corner cabinets has made their storage nearly impossible to do in a manner that is satisfactory for anyone who desires a neat and efficient kitchen. The problem of cookware storage has been compounded over the recent decades by the introduction and ubiquitous adaptation of non-stick cookware. This style of cookware utilizes Teflon as a non-stick surface between the cookware's metal surface and the food being cooked allowing the food to be easily removed from the cookware and ease in it's cleaning. Teflon used in this manner has one major drawback, it is fragile and susceptible to damage from contact with metal utensils or the metal from other pots and pans. Teflon coated cookware also has exposed metal bottoms, sides and handles which when stacked upon each other inside of corner cabinets causes the damaging contact that can cause the Teflon to peal from the cooking surface thus eliminating Teflon as an advantage to the cookware.

One method of safe guarding the Teflon coating of non-stick cookware would be to not stack the cookware in a manner that would allow metal to Teflon contact. This method of in cabinet storage would be an inefficient use of cabinet space, as each piece of cookware would need its own shelf area on the cabinet's shelves. Another alternative would be the use of a hanging cookware rack which would be mounted from the ceiling and hang in the kitchen exposed in the kitchen's open area. This method of cookware storage would leave the cookware exposed as well as consuming space in the kitchen that could be used for other purposes when the cookware is not needed. Cookware hanging in the kitchen and can be also an unsightly eyesore and consume kitchen open space.

There have been several attempts in the past to help lesson the problem of kitchen cookware and utensil cabinet storage but none have so far been satisfactory for conveniently and neatly store these items.

BACKGROUND OF INVENTION

Prior Art

There have been many attempts in the past to solve the problem of cookware and utensil storage in kitchens, and these attempts can be categorized into several types of devices invented.

The most popular device utilized for cookware and utensil storage is the hanging storage rack. These types of racks are most popular in larger kitchens where they can be hung in the open space of the kitchen thus taking up useful kitchen workspace. The cookware is also exposed creating an eyesore for most who desire a neat and clean kitchen. Most of these racks have been issued a Design patent since these racks have little or no unique features to produce unexpected results to warrant a Utility patent. Other attempts include pull out racks that are installed inside of cabinets or closets. While these types of racks are clever attempt to solve the cookware storage problem these racks tend to be complicated and thus expensive and difficult to install.

U.S. Pat. No. 2,758,904 issued May 28, 1954 to Hansell describes a pull out pan rack but unfortunately the product suffers from many shortcomings as a simple and functional solution to the cookware storage problem. Hansell's rack would slide in and out of the cabinet space, the rack itself constructed from pegboard or the like. The hanger is cumbersome in construction and installation and is not adjustable in size therefore could not universally fit different sized cabinets. The hooks are also only adjustable in which the positions the user had placed them prior to hanging utensils.

U.S. Pat. No. 3,198,594 issued to Murray Jul. 3, 1963 details a lazy susan style rotary rack. Murray specifies a rotating rack system that has two rotating shelves that are able to rotate independent of each other and does not require a center post. While these features may be beneficial compared to other lazy susan cabinet designs Murray's invention still utilizes shelves as the main means for storage for his cabinet storage solution. The use of shelves exclusively for storage will lend itself to an inefficient method for storage for cookware as the cookware would need to be stacked to save cabinet space or each piece of cookware would need its own shelf space thus consuming storage space in an inefficient manner.

Another method of cookware storage that incorporates the use of pull out cabinet racks is U.S. Pat. No. 3,379,484 issued April 1968 to Kilng. This patent details a pivoted rack for utensils and the like, which incorporates sheets of pegboard that can be swung outside of the cabinet storage space. Unfortunately this rack would not be functional in a cabinet that had a divider between the cabinet doors, and the hooks are only adjustable in which the positions the user had placed them prior to hanging utensils. The hanger is also cumbersome in construction and installation and is not adjustable in size therefore could not universally fit different sized cabinets.

U.S. Pat. No. 3,780,875 issued December 1973 to Scholl details a suspended hanger for pots and pans from an overhead surface. The device utilizes a base member and a column and a hanger assembly secured to the lower end of the column that rotates around the column. The hanger would be unable to fit inside of a conventional kitchen cabinet, as it would require a large vertically symmetric area for operating the rotational hanger feature of the device. The individual hangers cannot be independently positioned in relation to the other hangers therefore the entire device must be rotated in order to reposition the cookware.

U.S. Pat. No. 4,290,531 issued Sep. 22, 1981 to Lazarus details a device for holding cooking pots and lids. The device does hang pots and lids but fails to have adjustable or moveable hooks and the hooks must work in concert with lid holders to suspend both pots and lids.

U.S. Pat. No. 4,714,166 issued Dec. 22, 1987 to Hann and Fuller details a supporting rack for cooking utensils. The rack has a framed structure that supports several hooks along its framed perimeter. The rack was intended to hang from the kitchen ceiling or from another structure providing enough structural strength and area to hang the rack and the cookware hung by it. The hooks are only able to slide along the framed perimeter and are unable to pivot and rotate. This device was envisioned for use in an open area of the kitchen and not inside of a closed structure like a cabinet.

U.S. Pat. No. 5,238,127 issued Aug. 24, 1993 to Geller details a pan holder that is attached to the ceiling and stores pans in an overhead position near the end of a flexible cantilever beam which can be pulled down to allow easy removal of the pots and pans. The holder does not however allow for adjustable hooks whereby the hooks can be moved into different positions along the holder as well as not being able to pivot and rotate. The holder is intended for use in the open kitchen area and not compatible for use in a closed area such as a cabinet.

U.S. Pat. No. 5,249,856 issued to Dreier on Oct. 5, 1993 details a corner cupboard employing the usual rotating shelves as does other corner cupboards but Dreier's patent specifies a center shaft that does not need to be journalled or guided at the top. This configuration serves the purpose of having a top shelf whose top plane is not interrupted buy the intrusion of a center shaft thus allowing for a more efficient use of the top shelf. Dreier's invention unfortunately still relies upon shelves as the storage method which is inherently inefficient for the storage of cookware as the cookware would have to either be stacked to save the surface space of the shelves or each piece of cookware has its own space for storage upon the shelf thus consuming the surface space of the shelf in an inefficient manner.

U.S. Pat. No. 6,039,191 issued Jul. 2, 1997 to Purnell also details a hanging rack for being suspended from the ceiling in the open kitchen area. This structure is complicated in construction that results in a large, heavy, and expensive device for hanging cookware and utensils. The devices utilizes a plurality of bars from which it is to be hung from and hooks which are able to slide along the bars but unable to pivot and rotate.

Another attempt to solve the kitchen cookware and utensil storage problem is the introduction of pull out hanging racks. U.S. Pat. No. 6,227,387 issued May 8, 2001 to Rose details an apparatus for supporting utensils. Rose's design allows for the rack to be pulled out of the cabinet from it's supporting base, which would be mounted inside of a cabinet. Rose's design unfortunately does not allow for adjustable hooks. Rose's hooks are fixed to one piece thus not allowing for independent positioning of the hooks as well as his hooks cannot rotate and pivot. Rose's design also would make multiple cookware placement cumbersome since different pieces of cookware have different dimensions and would require different hook interval positions for each piece of cookware. Rose's sound accentuating feature would also make hanging and retrieving cookware less convenient since each one would be between adjacent cookware and thus become an obstacle to one using Rose's device.

Another method of storing cookware in a cabinet is the use of wire storage racks inside of the cabinet. U.S. Pat. No. 6,729,479 issued to Morgan on May 4, 2004 details a wire storage rack for pots and pans that can be mounted on a base. This style of storage device is unfortunately inconvenient in use since it requires the user to navigate the wires with cookware in it's storage in order to store the piece of cookware in hand. The device also uses the base of the cabinet instead of being able to hang from an overhead plane thus consuming the base of the cabinet's storage area while not offering more storage volume than a hanging device.

Another pull out hanging rack was patented U.S. Pat. No. 6,976,595 by Geller on Dec. 20, 2005. Geller's patent unfortunately suffers from some of the same shortcomings as Rose's patent in that the hooks remain stationary and therefore does not allow the assembly to fully accommodate the user's need for adjustability for storing and retrieving varying sized and shaped cookware. Geller's and Rose's assemblies would also require a cabinet space which is deep in length from front to back to accommodate a pull out rack of this nature, something rarely seen in any kitchen as most cabinets are wider than they are long.

U.S. Pat. Nos. 7,104,409, 7,121,413, and 7,007,808 all detail wire storage racks of similar configuration as Morgan's patent, and all unfortunately all suffer from the same short comings as Morgan's patent as they are all complicated in construction and use.

OBJECTS AND ADVANTAGES

The advantages of the in cabinet kitchen cookware hanger are as follows:

(a) to provide a more efficient method to utilize the storage volume inside of a kitchen corner cabinet for cookware and utensil storage;

(b) to provide a more efficient and convenient method of cookware and utensil storage and retrieval during kitchen operation;

(c) to provide an improved method of cookware and utensil organization;

(d) to provide a cookware storage solution for fragile Teflon coated cookware from the damage that could occur if the cookware was to be stored in with conventional methods;

(e) to provide adjustable hanger assemblies to accommodate varying sizes of storage areas in which the assemblies would be installed.

Further objects and advantages of my invention will become apparent from a consideration of the drawings and ensuing description.

SUMMARY

The rotary track mechanism for corner cabinets is an assembly for hanging implements with accommodating appendages inside the confines of a corner cabinet. The rotary track mechanism is primarily a circular track that is attached to a central vertical shaft that is anchored centrally inside of a corner cabinet. The circular track would support hanger assemblies whose positions are adjustable along the length of the circular track, the hanger assemblies have hooks which hang in a downward vertical position that can rotate and pivot on their vertical axis from the hanger assemblies.

DRAWINGS

REFERENCE NUMERALS

Figure 1:
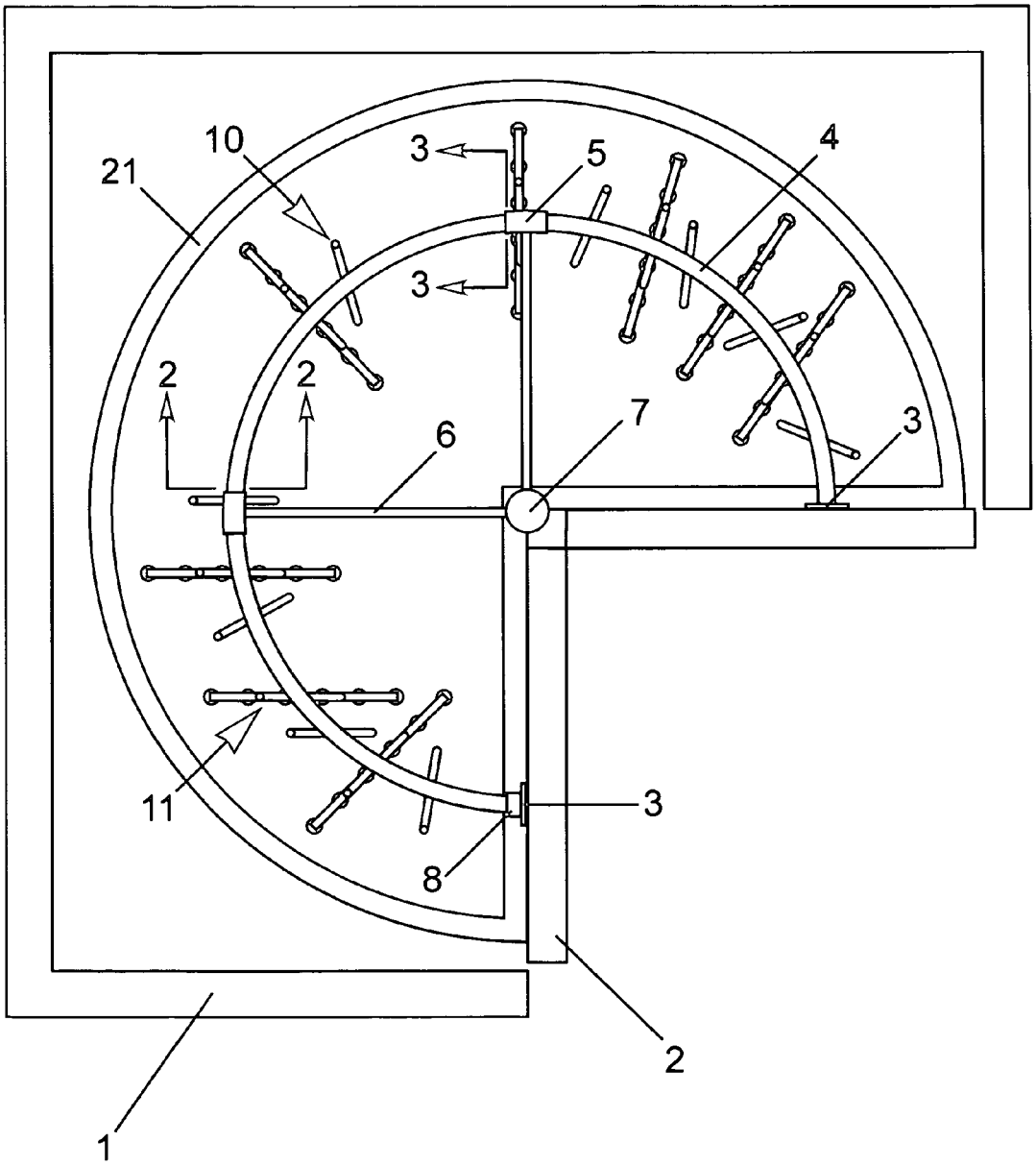
FIG. 1 is a top view of the cookware and utensil hanging assembly for corner cabinets with a lower circular shelf.

1. Corner cabinet
2. Cabinet door
3. Hanging track bracket
4. Hanging track
5. Hanging track clamp
6. Hanging track support
7. Center shaft
8. Hanging track channel closure
9. Cabinet door hinge
10. Hanger assembly
11. Hanging guard assembly
12. Center shaft bracket
13. Hanger assembly ball end
14. Track Slot
15. Hanger assembly hook end
16. Hanger assembly hook shaft
17. Hanging protector assembly hook
18. Hanging protector assembly shoulder
19. Hanging protector assembly guard
20. Hanging protector assembly guard end
21. Circular Shelf
22. Hanger extension
23. Hanging protector assembly main shaft
24. Cabinet door hinge

DETAILED DESCRIPTION

FIGS. 1-5 Preferred Embodiment

FIG. 1 is a top view of the rotary track mechanism for corner cabinets. A corner cabinet 1 and cabinet door 2 contains the hanging assembly. Hanging track brackets 3 connects the hanging track 4 to cabinet door 2. Hanging track clamps 5 attach the track 4 to hanging track supports 6 that are attached to the center shaft 7, all of which with brackets 3 support the weight of the assembly and the items that are hung from the hanging assembly. Hanging track channel closure 8 allows for the addition or removal of hanger assemblies 10 from track 4. Hanger assemblies 10, and hanging guard assemblies 11 are supported from track 4 that is detailed in FIG. 2 and FIG. 3. A circular shelf 21 is attached to the lower end of the shaft 7 and is also connected to cabinet door 2.

Figure 2:
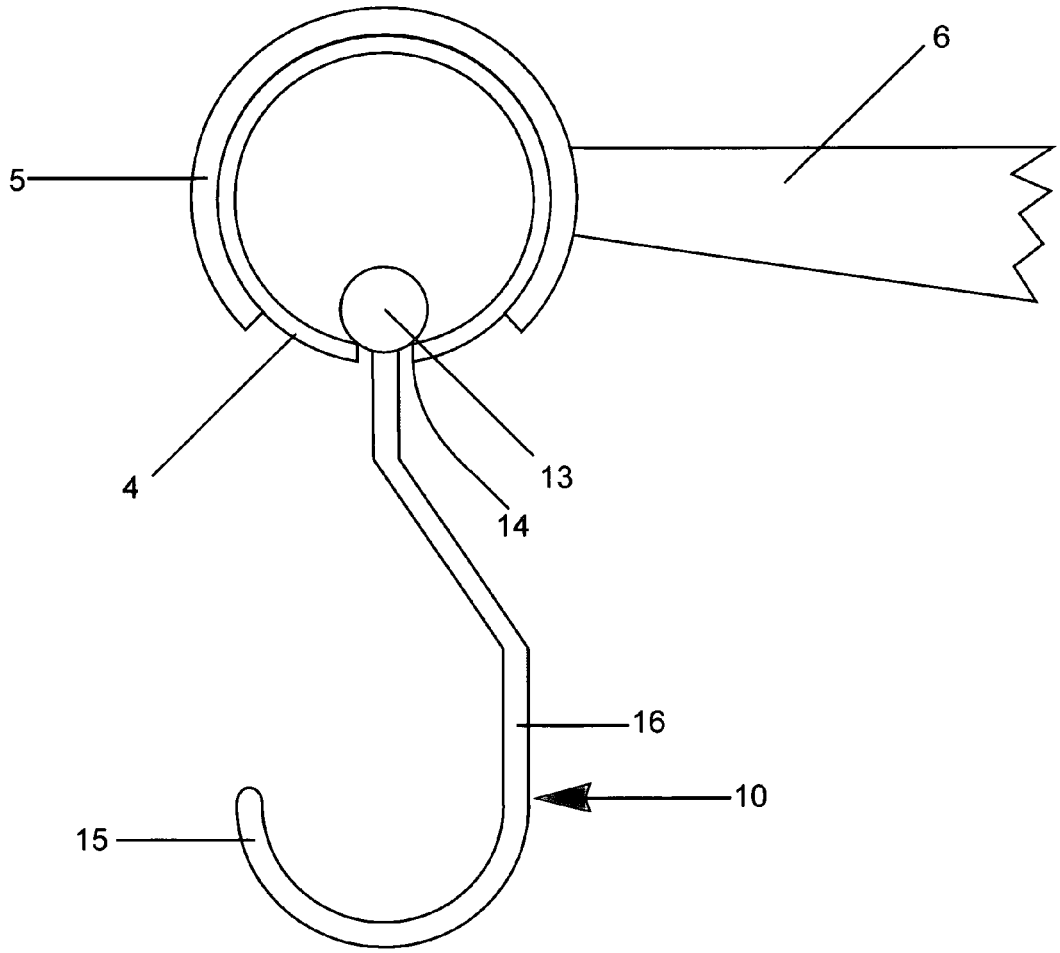
FIG. 2 is a cross-section view from FIG. 1 detailing the hanging track and hanging assembly.

FIG. 2 is a cross-section from FIG. 1 detailing the hanger assembly 10 and the hanging track 4. Hanging track clamp 5 attaches and supports hanging track 4 to hanging track support 6. Track 4 supports hanger assemblies 10 through a track slot 14 by hanger assembly ball end 13 attached to hanger assembly hook shaft 16. Hanger assembly hook end 15 receives accommodating articles to be hung by the hanging assembly.

Figure 3:
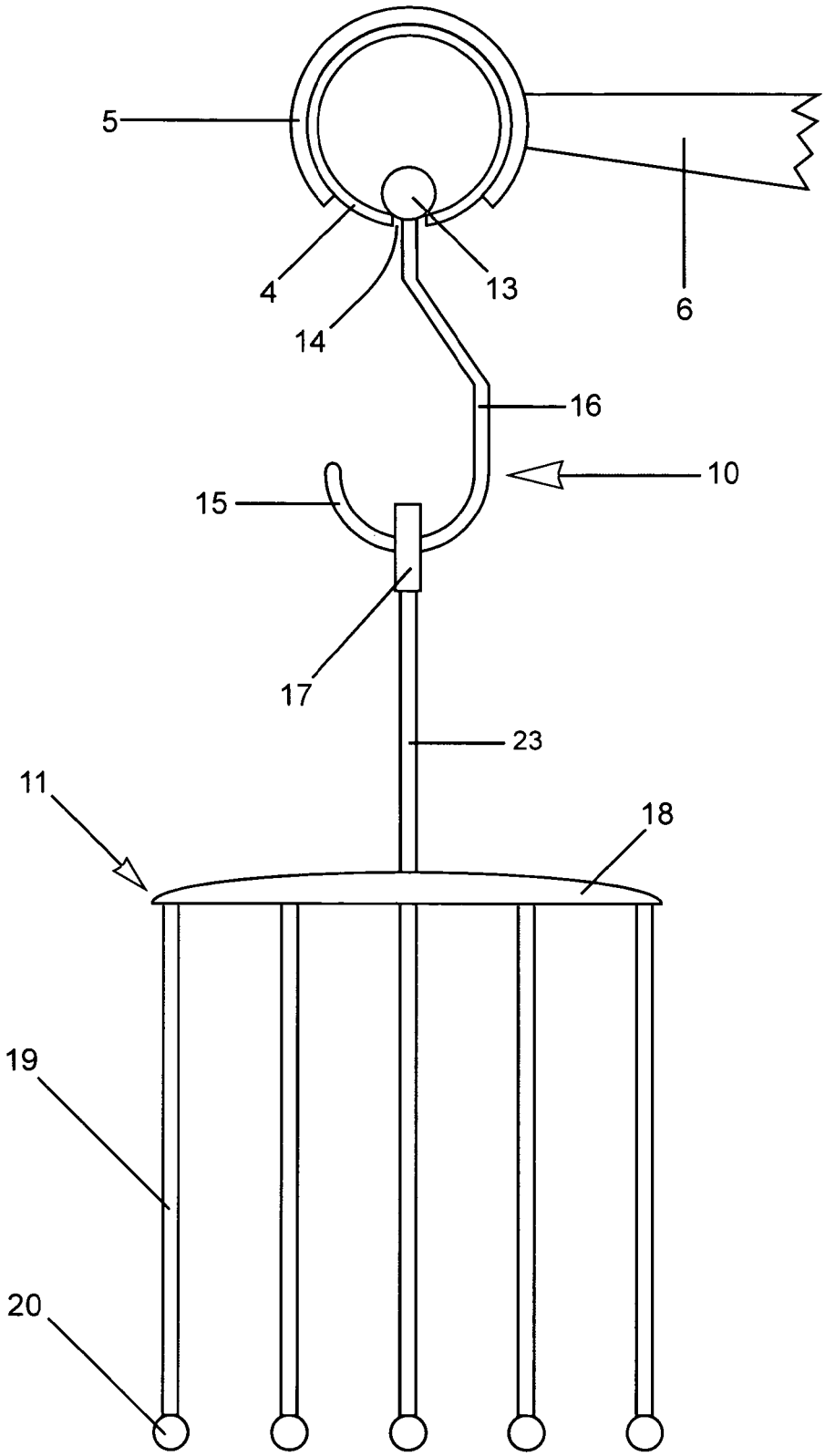
FIG. 3 is a cross-section view from FIG. 1 detailing the hanging track and hanging guard assembly.

FIG. 3 is a side view of the hanging guard assembly 11, hanger assembly 10, and hanging track 4. Clamp 5 attaches and supports track 4 to track support 6. Track 4 supports the hanger assembly 10 through track slot 14 by a ball end 13. Hanger assembly 10 supports hanging guard assembly 11 from hanger assembly hook end 15. Hanging guard assembly 11 consists of hanging protector assembly hook 17 connected to hanging protector assembly main shaft 23 that is connected to hanging protector assembly shoulder 18. Shoulder 18 supports hanging protector assembly guards 19 which support hanging protector assembly guard ends 20.

Figure 4:
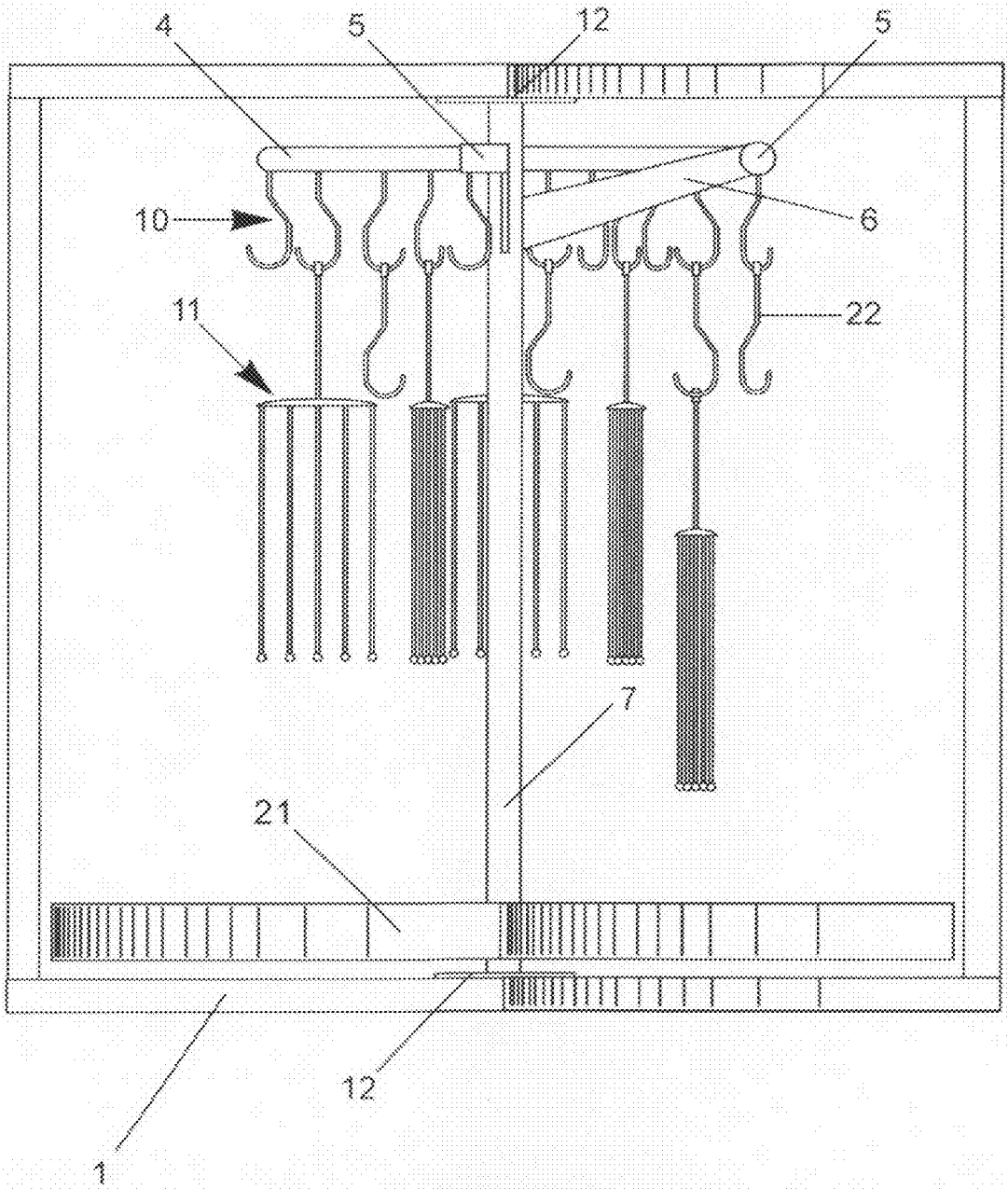
FIG. 4 is a side view of the cookware and utensil hanging assembly for corner cabinets with the hanging track and circular shelf being attachable to the cabinet door.

FIG. 4 is a side view of the rotary track mechanism for corner cabinets. A corner cabinet 1 contains the hanging assembly. Clamps 5 attach track 4 to track supports 6 which are attached to the shaft 7. Track 4 supports hanger assemblies 10 that support both hanger extensions 22 and hanging guard assemblies 11. Center shaft bracket 12 supports shaft 7 that supports the rotary track mechanism and circular shelf 21.

Figure 5:
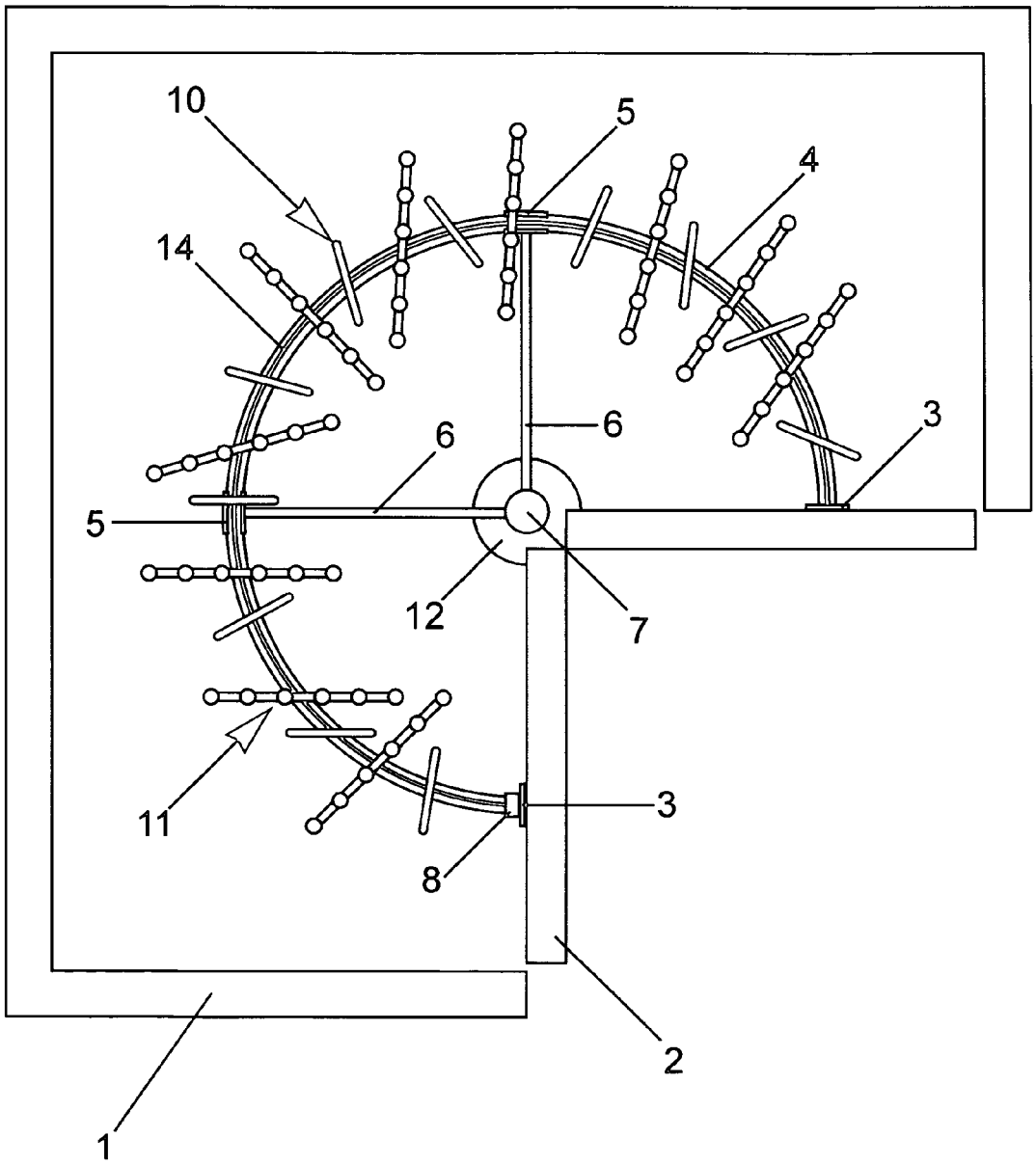
FIG. 5 is a bottom view of the cookware and utensil hanging assembly for corner cabinets with out the circular shelf.

FIG. 5 is a bottom view of the rotary track mechanism for corner cabinets. A corner cabinet 1 and cabinet door 2 contains the hanging assembly. Brackets 3 connect the track 4 to door 2. Clamps 5 attach the track 4 to track supports 6 that are attached to shaft 7, all of which with brackets 3 support the weight of the assembly and the items that are hung from the hanging assembly. Hanging track channel closure 8 allows for the addition or removal of hanger assemblies 10 from track 4. Hanger assemblies 10 and hanging guard assemblies 11 are supported from the hanging track 4 through track slot 14.

Operation

FIGS. 1-5 Preferred Embodiment

FIG. 1 is a top view, FIG. 4 is a side view and FIG. 5 is a bottom view of the rotary track mechanism for corner cabinets. Track 4 is connected to track clamps 5 which are connected to track supports 6 which are suspended by center shaft 7 inside of a corner cabinet 1. Center shaft brackets 12 supports shaft 7 in a vertical position inside of cabinet 1. Track brackets 3 also support track 4 by connecting track 4 to cabinet door 2. The cookware and utensil hanging assembly for corner cabinets, circular shelf 21, and cabinet door 2 are able to rotate 360° around the axis formed by shaft 7. Hanger assemblies 10 are supported by track 4 through track slot 14 and are capable of changing position anywhere along track 4 except for where another assembly is already in position.

FIG. 2 shows hanger assemblies 10 that are supported by hanger track 4 by hanger assembly ball end 13 through track slot 14. Track 4 is supported by track clamp 5 which are supported by track support 6. Hanger assemblies consist of hanger assembly ball end 13, hanger assembly hook end 15, and hanger assembly hook shaft 16. Hanger assemblies are capable of changing position anywhere along track 4 except for where another assembly 10 or guard assembly 11 is already in position. Hanger assemblies 10 can pivot and rotate from their vertical axis to better access and position the utensil or cookware that is hung from the hanger assembly 10.

FIG. 3 shows hanging guard assembly 11 supported by hanger assembly 10 that is supported by track 4 through slot 14. The hanging guard is capable of changing position anywhere along track 4 while supported by hanger assembly 10 except for where another assembly 10 is already in position. Guard assemblies 11 are able to rotate and pivot from the vertical axis of the accommodating hanger assembly 10 to better accommodate the positions of utensils and cookware hanging from the rotary track mechanism. The hanging guard assembly 11 consists of a hanging protector assembly hook 17, hanging protector assembly main shaft 23, hanging protector assembly shoulder 18, hanging protector assembly guards 19 and may or may not have hanging protector guard ends 20. Guard assemblies 11 hang in a downward vertical position from hanger assemblies 10 that hang from track 4.

Guards 19 and guard ends 20 are constructed from a material, such as rubber, that would protect cookware or utensils from contact with each other when the rotary track mechanism is rotated or when the cookware or utensils are moved.

FIG. 4 is a side view of the rotary track mechanism for corner cabinets. A corner cabinet 1 contains the cookware and utensil hanging assembly. Clamps 5 attach track 4 to track supports 6 which are attached to the shaft 7. The entire rotary track mechanism, shelf 21 and cabinet door 2, which is not shown in FIG. 4, are able to rotate in concert with each other around the axis of the shaft 7. Track 4 supports hanger assemblies 10 that support both hanger extensions 22 and guard assemblies 11. Extensions 22 can be attached to hanger assembly 10 in order to extend downward the position of utensils, cookware, or hanging guard assemblies 11 and are able to be positioned in concert with hanger assembly 10 along track 4.

DETAILED DESCRIPTION

Figure 6:
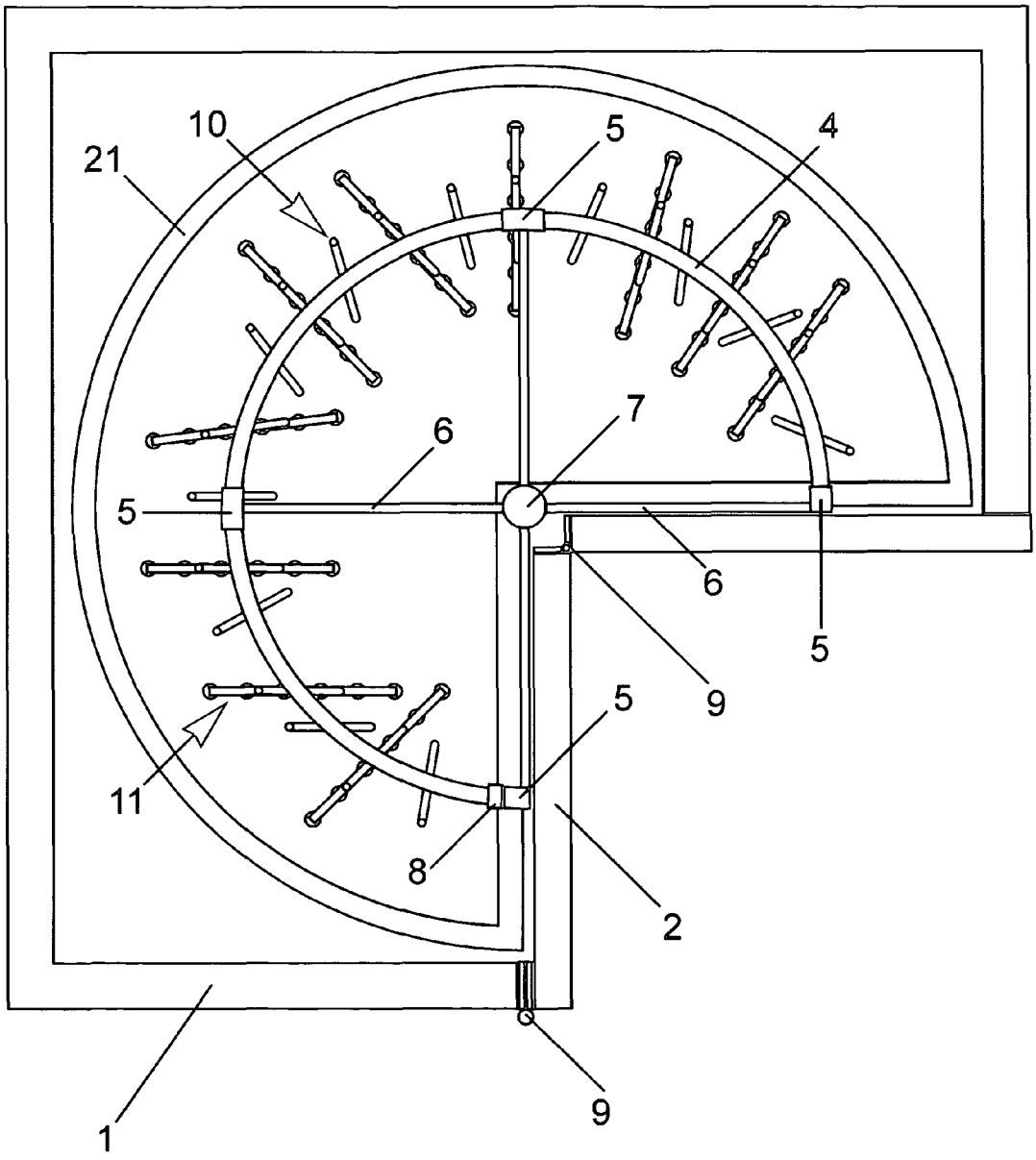
FIG. 6 is a top view of the cookware and utensil hanging assembly for corner cabinets including the circular shelf and the hanging track is not attached to the cabinet door.

FIGS. 2, 3, and 6 Door Independent Support Assembly

FIG. 6 is a top view of the rotary track mechanism for corner cabinets with door independent support. A corner cabinet 1 and cabinet door 2 contains the hanging assembly. Cabinet door 2 is unattached to the rotary track mechanism and circular shelf 21. Cabinet door hinge 9 allows door 2 to open outward from the cabinet 1 to allow access to the interior of cabinet 1 and cookware and utensil hanging assembly. Clamps 5 attach track 4 to track supports 6 that are attached to shaft 7, all of which supports the weight of the assembly and the items that are hung from the hanging assembly. Closure 8 allows for the addition or removal of hanger assemblies 10 from hanging track 4. Hanger assemblies 10, and hanging guard assemblies 11 are supported from track 4 that is detailed in FIG. 2 and FIG. 3. A circular shelf 21 is attached to the lower end of the center shaft and is also independent from door 2.

Operation

FIGS. 2, 3, and 6 Door Independent Support Assembly

FIG. 6 is a top view of the rotary track mechanism for corner cabinets with door independent support. A corner cabinet 1 and cabinet door 2 contains the hanging assembly. Cabinet door 2 is unattached to the cookware and utensil hanging assembly and circular shelf 21. Cabinet door hinge 9 allows door 2 to open outward from the cabinet 1 to allow access to the interior of cabinet 1 and Cookware and Utensil Hanging Assembly. Clamps 5 attach track 4 to track supports 6 that are attached to shaft 7, all of which supports the weight of the assembly and the items that are hung from the hanging assembly. Closure 8 allows for the addition or removal of hanger assemblies 10 from hanging track 4. Hanger assemblies 10, and hanging guard assemblies 11 are supported from track 4 that is detailed in FIG. 2 and FIG. 3. A circular shelf 21 is attached to the lower end of the center shaft and is also independent from door 2. The door independent support embodiment of the rotary track mechanism and shelf 21 are not attached to cabinet door 2 and thus able to rotate independent of the cabinet door 2 when the door is open. The weight of the rotary track mechanism is completely supported by shaft 7, supports 6, and clamps 5.

I claim:

1. A rotary track mechanism for suspending articles within a corner cabinet having an interior with an interior top surface and interior bottom surface and a door, the rotary track mechanism comprising:

a) a central vertical shaft positioned in the interior of the corner cabinet for rotation therein;

b) first and second shaft brackets spaced apart and opposing each other, the first shaft bracket mounted on the interior top surface and the second shaft bracket mounted on the interior bottom surface of the corner cabinet, the vertical shaft having first and second ends disposed at lengthwise between the first and second shaft brackets, the shaft forms a vertical rotatable axis;

c) a circular track; wherein said circular track is configured to accept and be attached to the interior of the cabinet door of said corner cabinet whereby the door also partially bears the weight of said circular track and whereby both the door and said rotary track mechanism are able to rotate in unison;

d) a plurality of track supports; wherein each of the track supports having ends connected to the vertical shaft and the circular track respectively;

e) a plurality of hanger assemblies coupled to the circular track, the positions of said hanger assemblies are adjustable along the length of said circular track, and wherein each of the hanger assembly comprising: a pivoting mechanism configured to allow said hanger assemblies to pivot and rotate a predetermined number of degrees from the circular track, and a hooking mechanism configured to hold articles in a vertical position; and f) hanging guard assemblies suspended vertically from the hanger assemblies, each hanging guard assembly comprising an elongated shoulder having guards extending downwardly therefrom to protect said articles from contact with each other during rotation of the hanger assemblies or when the articles are moved.

2. The article from claim 1 further including a circular shelf attached to said shaft, said shelf is positioned below said circular track and said shelf is configured to accept and be attached to the inside of said door whereby said shelf, said door, and said rotary track mechanism are able to rotate together.

3. The article from claim 1 further including at least one hanger extension, said hanger extension is attachable to said hanger assembly and said hanger extension is configured to hold an accommodating article in a downward vertical position whereby said hanger extension increases the distance from which said articles hang from said rotary track mechanism.

4. The article from claim 3 further including a circular shelf attached to said shaft, said shelf is positioned below said circular track and said shelf is configured to accept and be attached to the inside of said door whereby said shelf, said door, and said rotary track mechanism are able to rotate together.

* * * * *